US006931763B2

(12) United States Patent
Bray, Jr. et al.

(10) Patent No.: US 6,931,763 B2
(45) Date of Patent: Aug. 23, 2005

(54) SLIPPER INSOLE, SLIPPER, AND METHOD FOR MANUFACTURING A SLIPPER

(75) Inventors: Walter Thomas Bray, Jr., Reynoldsburg, OH (US); Theresa Stewart, Columbus, OH (US)

(73) Assignee: R.G. Barry Corporation, Pickerington, OH (US)

( * ) Notice: Subject to any disclaimer, the term of this patent is extended or adjusted under 35 U.S.C. 154(b) by 0 days.

(21) Appl. No.: 10/634,508

(22) Filed: Aug. 5, 2003

(65) Prior Publication Data

US 2004/0134095 A1 Jul. 15, 2004

Related U.S. Application Data

(63) Continuation-in-part of application No. 10/213,276, filed on Aug. 5, 2002.

(51) Int. Cl.[7] ..... A43B 1/02

(52) U.S. Cl. ..... 36/9 R; 36/44; 36/11; 12/142 T

(58) Field of Search ..... 36/9 R, 43, 44, 36/71, 11, 12; 12/142 T, 142 G

(56) References Cited

U.S. PATENT DOCUMENTS

| | | | | |
|---|---|---|---|---|
| D62,779 | S | 7/1923 | Hirshfield | D2/921 |
| D64,599 | S | 5/1924 | Muntener | D2/922 |
| RE18,237 | E | 10/1931 | Messler | |
| D119,742 | S | 4/1940 | Debusschere | D2/919 |
| D120,316 | S | 4/1940 | Reeves | D2/959 |
| D135,347 | S | 3/1943 | Pierson | D2/960 |
| D136,381 | S | 9/1943 | Ghez et al. | D2/960 |
| D170,768 | S | 11/1953 | Preti | D2/922 |
| D174,475 | S | 4/1955 | Smith | D2/923 |
| 2,715,285 | A | 8/1955 | Del Vecchio | |
| 3,468,040 | A | 9/1969 | Fukuoka | |

(Continued)

OTHER PUBLICATIONS

Declaration of Walter Thomas Bray, Jr. including Exhibits A–I (Color Photographs).

*Primary Examiner*—Jila M. Mohandesi
(74) *Attorney, Agent, or Firm*—Merchant & Gould P.C.

(57) ABSTRACT

An insole is described that can be placed with an insole receiving area of a slipper. The insole can be prepared by molding a structure comprising a foam layer having a first foam side and a second foam side. The insole includes a heel region, an arch region, and a toe region. The heel region includes a heel cushioning portion and a heel perimeter portion. The heel perimeter portion includes a retaining wall that extends above the top surface of the heel cushioning portion. The arch region includes an arch cushioning portion and an arch perimeter portion. The arch perimeter portion includes an arch support that extends above the top surface of the arch cushioning portion. The toe region includes a toe cushioning portion and a toe perimeter portion. A slipper and a method for manufacturing a slipper are described.

30 Claims, 15 Drawing Sheets

U.S. PATENT DOCUMENTS 3,766,669 A 10/1973 Pearsall
4,020,569 A 5/1977 Fukuoka
4,020,570 A 5/1977 Shames
4,033,054 A 7/1977 Fukuoka
4,124,946 A 11/1978 Tomlin
4,129,697 A 12/1978 Schapel et al.
D276,003 S 10/1984 McAbery ..... D2/921
4,508,774 A 4/1985 Grabhoefer et al.
4,513,518 A 4/1985 Jalbert et al.
D284,901 S 8/1986 Tilles
4,627,177 A 12/1986 Meyers
4,633,877 A 1/1987 Pendergast
4,674,204 A 6/1987 Sullivan et al.
D294,537 S 3/1988 Le ..... D2/960
4,741,951 A 5/1988 Ricciardi et al.
4,760,655 A 8/1988 Mauch
4,864,740 A 9/1989 Oakley
5,146,698 A 9/1992 Tilles et al.
5,167,999 A 12/1992 Wang
5,203,793 A 4/1993 Lyden
D354,389 S 1/1995 Howlett et al.
D354,844 S 1/1995 Rinehart
5,392,532 A 2/1995 Bray, Jr. et al.
5,435,077 A 7/1995 Pyle
D366,140 S 1/1996 Finn
5,483,757 A 1/1996 Frykberg
D366,956 S 2/1996 Gay
5,542,196 A * 8/1996 Kantro ..... 36/44
5,544,432 A 8/1996 Kita
5,551,173 A 9/1996 Chambers
5,611,153 A 3/1997 Fisher et al.
5,664,342 A 9/1997 Buchsenschuss
5,669,162 A 9/1997 Dyer
5,675,914 A 10/1997 Cintron
5,718,064 A 2/1998 Pyle
5,787,608 A 8/1998 Greenawalt
D399,042 S 10/1998 Strawser et al.
D418,281 S 1/2000 Bray et al. ..... D2/919
D423,766 S 5/2000 Genga
D426,373 S 6/2000 Allen et al.
D432,769 S 10/2000 Yung et al.
6,176,025 B1 * 1/2001 Patterson et al. ..... 36/28
6,219,941 B1 4/2001 Kukoff
6,226,894 B1 5/2001 Bray, Jr. et al.
6,286,232 B1 9/2001 Snyder et al.
6,338,768 B1 * 1/2002 Chi ..... 156/269
6,418,642 B1 7/2002 Bigg et al.
6,662,469 B2 * 12/2003 Belley et al. ..... 36/16
D485,664 S 1/2004 Bray, Jr. et al.
D485,665 S 1/2004 Bray, Jr. et al.
D485,666 S 1/2004 Bray, Jr. et al.
D490,970 S 6/2004 Bray, Jr. et al.

* cited by examiner

SLIPPER INSOLE, SLIPPER, AND METHOD FOR MANUFACTURING A SLIPPER

CROSS REFERENCE TO RELATED APPLICATION

This application is a continuation-in-part of U.S. application Ser. No. 10/213,276 that was filed with the United States Patent and Trademark Office on Aug. 5, 2002. The entire disclosure of U.S. application Ser. No. 10/213,276 is incorporated herein by reference.

FIELD OF THE INVENTION

The invention relates to a slipper insole, a slipper, and a method for manufacturing a slipper.

BACKGROUND OF THE INVENTION

The footwear industry is an old and crowded art. The industry is constantly attempting to design new products with aesthetic appeal, as well as being comfortable and having ease of construction.

Various designs of slippers have been available for a number of years. See U.S. Pat. No. 5,392,532 (Bray, Jr. et al.) and U.S. Pat. No. 6,226,894 (Bray, Jr. et al.) In general, slippers are a type of footwear having a generally soft construction and are generally washable in a conventional clothes washing machine. Slippers are typically not manufactured using a last, which is often a necessary device when manufacturing a shoe, including a hard sole and a leather upper.

Insoles for various shoes and slippers have been manufactured using compression molding of various polymers. See U.S. Pat. No. 5,551,173 (Chambers) and U.S. Pat. No. 3,766,669 (Pearsall). The insole provides a cushion and support for the foot. The comfort felt by the wearer of a shoe or slipper depends, in large part, on the ability of this foam insole to redistribute the various forces imposed on the foot during walking and standing. These forces are greatest in the heel, arch, and forefoot regions.

SUMMARY OF THE INVENTION

An insole is provided according to the invention. The insole can be referred to as a contoured footbed and can be placed within an insole receiving area of a slipper. The insole can be prepared by compression molding a structure comprising a foam layer having a first foam side and a second foam side. The insole includes a heel region, an arch region, and a toe region. The heel region includes a heel cushioning portion and a heel perimeter portion. The heel perimeter portion includes a retaining wall that extends above the top surface of the heel cushioning portion. The arch region includes an arch cushioning portion and an arch perimeter portion. The arch perimeter portion includes an arch support that extends above the top surface of the arch cushioning portion. The toe region includes a toe cushioning portion and a toe perimeter portion.

A slipper is provided according to the invention. The slipper includes an outsole, an upper, and an insole. The outsole includes a top outsole side, a bottom outsole side, and an outsole retaining wall extending along a circumference of the outsole. The upper includes an outsole attachment area and a foot covering area, and can include a stabilizing member. The stabilizing member, when included, can be attached along the outsole attachment area to provide an insole receiving area between the stabilizing member and the foot covering area. If the upper does not include a stabilizing member, the insole receiving area can be provided between the outsole and the foot covering area. The insole can be placed within the insole receiving area.

A method for manufacturing a slipper that includes an upper attached to an outsole is provided by the invention. The method includes a step of placing an insole within the insole receiving area formed within the upper or between the upper and the outsole.

DETAILED DESCRIPTION OF THE INVENTION

Figure 1:
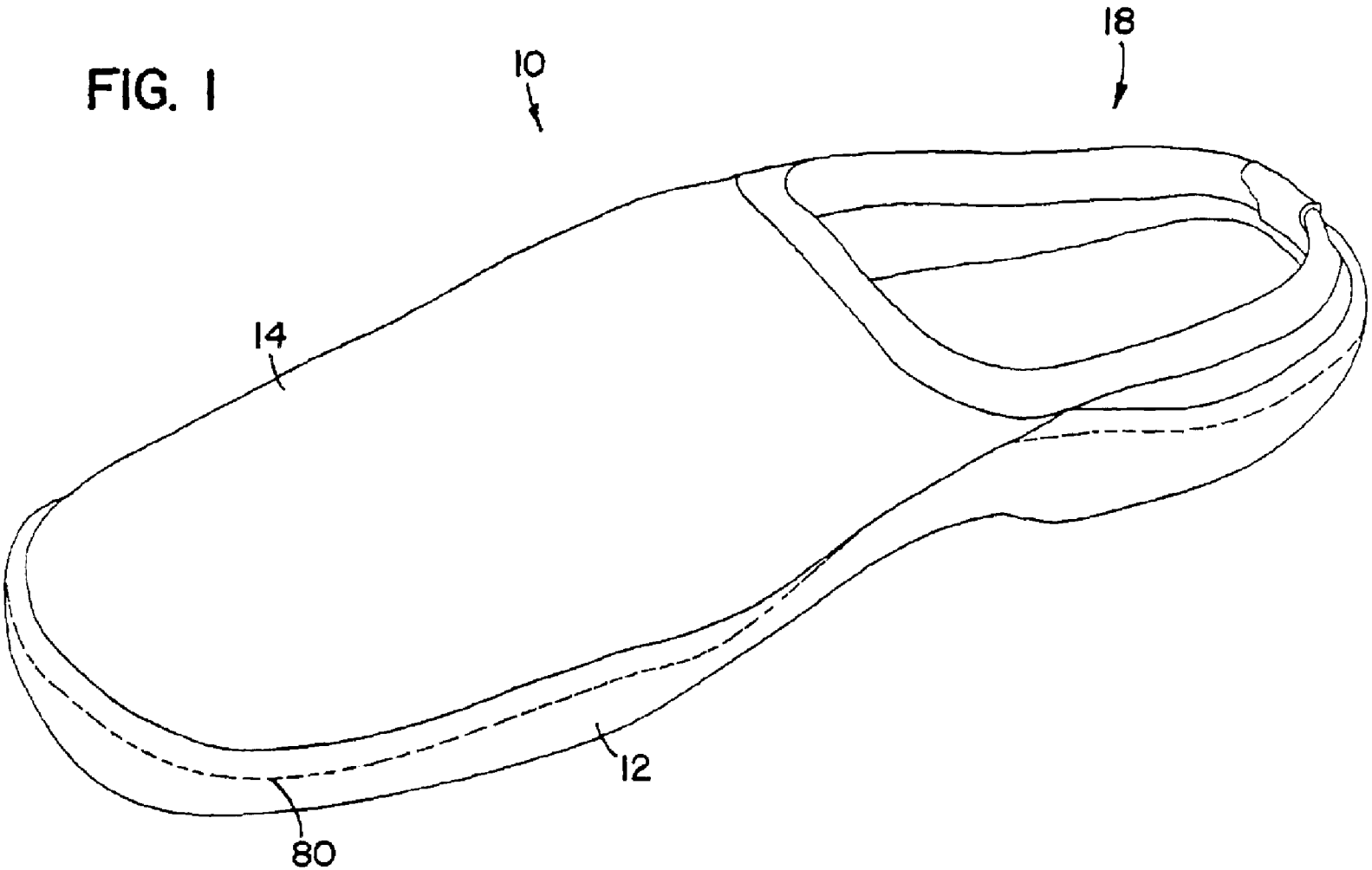
FIG. 1 is a perspective view of a slipper construction according to the principles of the invention wherein the contoured footbed has been removed.

Referring to FIGS. 1–5, a slipper according to the present invention is shown at reference numeral 10. The slipper 10 includes an outsole 12, an upper 14, and an insole 16. The insole 16 is removable from the insole receiving area 18 and is shown removed in FIGS. 1 and 5. The slipper 10 can be characterized as having a generally soft construction while providing support for a wearer's foot.

Figure 3:
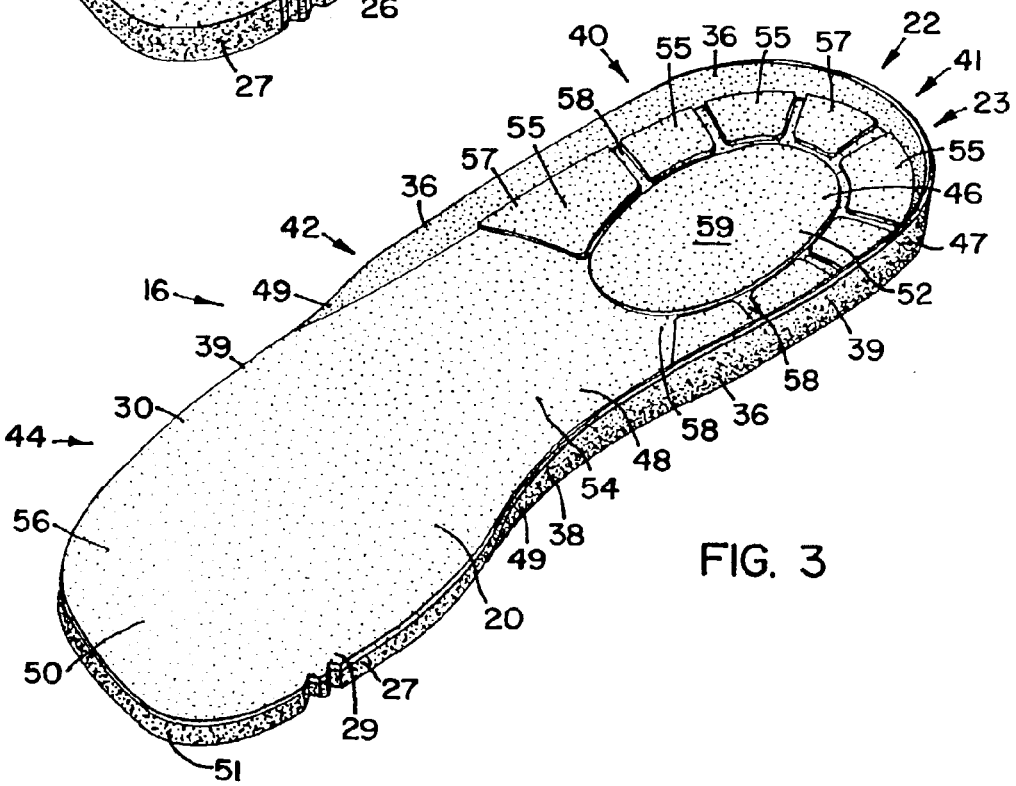
FIG. 3 is a perspective view of an insole according to the principles of the invention.
Figure 4:
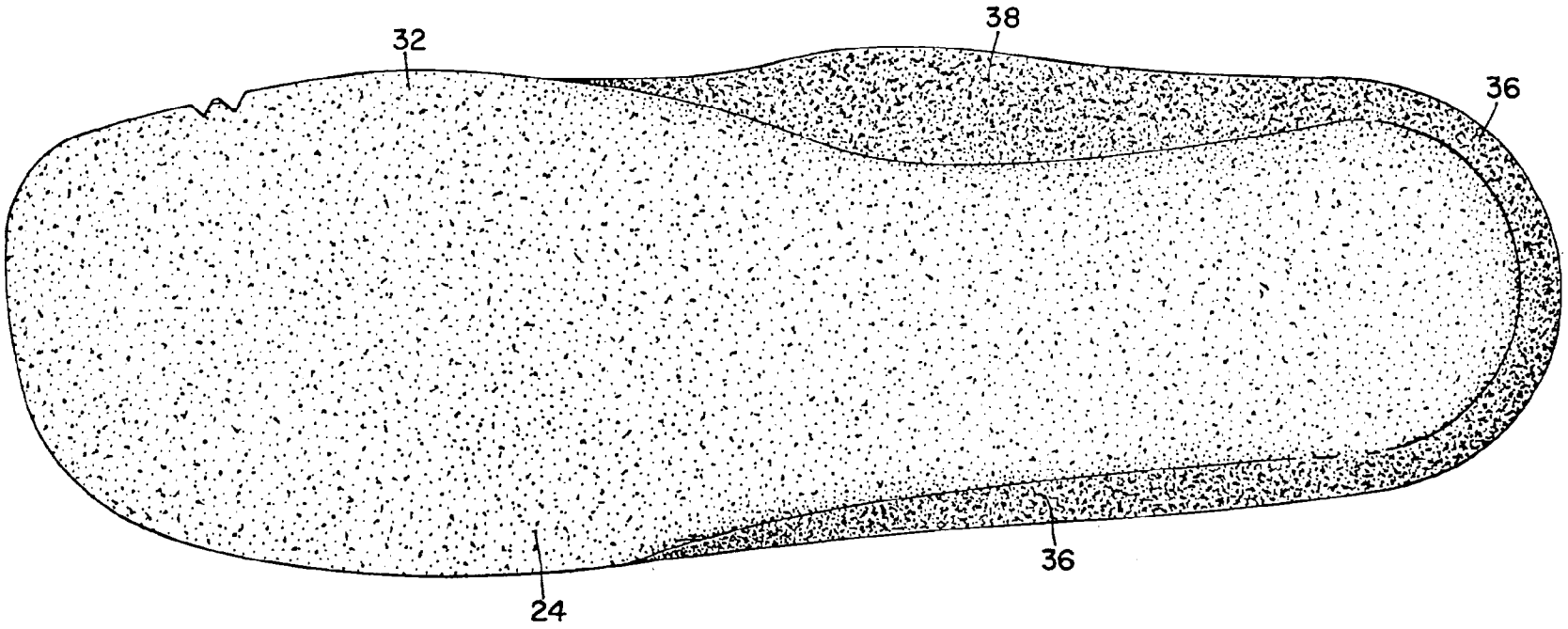
FIG. 4 is a bottom view of the insole of FIG. 3.

The insole 16 has a top surface 20 and a bottom surface 24. As shown in FIG. 3, the top surface 20 includes a contour design 22 in a heel cup region 23. When the insole 16 is provided within the insole receiving area 18, the contour design 22 is readily visible to someone looking at the slipper 10. It is believed that the contour design 22 provides visual interest for a customer of the slipper and may cause the customer to examine the slipper 10 more closely. It is believed that customers will associate the contour design 22 with slippers having an insole according to the invention. In addition, the contour design 22 is believed to provide additional cushioning.

The insole 16 can be assembled by laminating a first layer 26 and a second layer 28 to provide a laminate construction 30, and compression molding the laminate construction 30. The first layer 26 can be a foam layer 27, and the second layer 28 can be a fabric layer 29. The foam layer 27 includes a first foam side 31 and a second foam side 32. The fabric layer 29 includes a first fabric side 33 and a second fabric side 34. The fabric layer 29 is placed over the foam layer 27 so that the second fabric side 34 is adjacent to the first foam side 31. The fabric layer 29 can be held in place on the foam layer 27 by an adhesive. Adhesive can be applied as a dry powder adhesive, a hot melt adhesive, a water based adhesive, etc. to hold the fabric layer 29 in place on the foam layer 27. It is expected that the compression molding step will cause a portion of the foam layer 27 to melt thereby creating a bond between the fabric layer 29 and the foam layer 27. It should be understood that compression molding is a generally well known technique for molding to create a molded article. To the extent molding techniques other than compression molding can be used to prepare the insole according to the invention, those techniques can generally be referred to as "molding."

The foam layer 27 can be prepared from any foam material that exhibits the desired level of support and resiliency that is appropriate for use as an insole. It should be understood that the characterization of the desired level of support and resiliency refers to properties after molding to provide the insole. An exemplary foam material that can be used includes ethylene vinyl acetate. A particular form of ethylene vinyl acetate that can be used is sponge ethylene vinyl acetate. The density of the foam layer should be sufficient to provide the desired level of support after the foam has been compression molded. If the foam density is too low, it is expected that insufficient support will be provided. If the foam density is too high, it is expected that the foam will be too rigid. A desirable foam density range can be between about 4 $lb/ft^2$ and about 10 $lb/ft^2$ prior to compression molding. In general, it is difficult to measure the density of the foam layer 27 after compression molding because different parts of the insole 16 can be compressed to different levels and thereby provide different densities.

Figure 2:
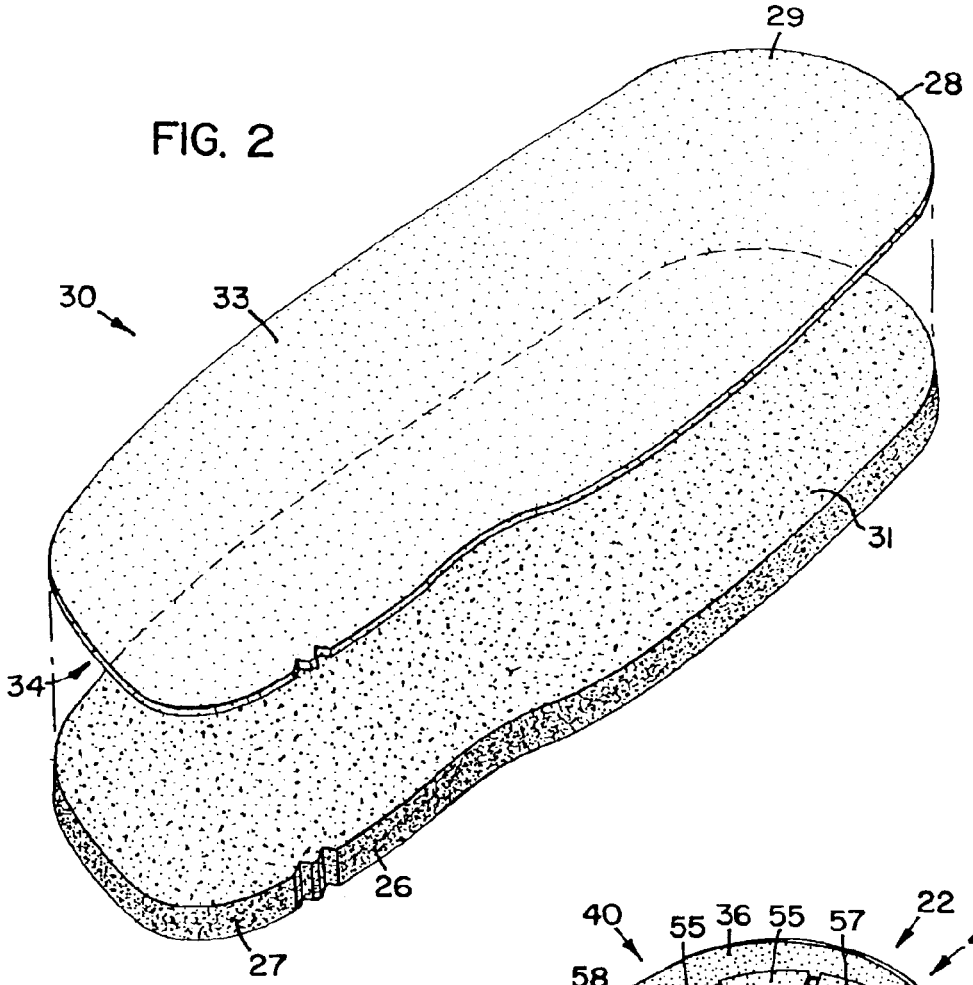
FIG. 2 is a perspective, assembly view of an insole according to the principles of the invention prior to compression molding.

It is pointed out that the foam layer 27 shown in FIG. 2 is not necessarily drawn to scale. It is expected that a relatively thick foam layer 27 will be compressed to provide the insole 16. For example, the foam layer can be provided as a 3 inch block that is molded to provide a desired final thickness. In addition, the foam layer can be provided as multiple layers of foam materials that may be the same or different.

The fabric layer 29 can be provided from any type of fabric material that adheres to the foam layer 27 and provides a desired surface texture. The fabric layer can be a woven material, a nonwoven material, or a knitted material. Because it is desirable for the contour design 22 to be visible, it is generally desirable for the fabric layer 29 to have a nap that is sufficiently small (if it exists at all) so it does not obscure the contour design 22. In general, it is expected that the nap will be less than about 4 mm. An exemplary fabric material that can be used includes microfiber sueded fabric. An exemplary microfiber sueded fabric includes a fabric prepared from polyester.

It should be understood that the insole according to the invention can be provided without the fabric layer 29. If there is no fabric layer 29, the wearer's foot can directly contact the foam layer 27. It is expected that the fabric layer, when present, can be selected to provide a desired feel against the wearer's foot.

The insole 16 additionally includes a retaining wall 36 and an arch support 38. The contour design 22, the retaining wall 36, and the arch support 38 can be formed during the compression molding step. The retaining wall 36 extends along a portion of the insole perimeter 39. The arch support 38 extends along a portion of the insole perimeter in the region where arch support is desired.

The insole 16 includes three general regions. These regions include a heel region 40, an arch region 42, and a toe region 44. In general, the heel region 40 includes that portion of the insole 16 that generally contains and supports the wearer's heel. The toe region 44 includes that portion of the insole 16 that generally contains and supports the wearer's toes. The arch region 42 is generally that portion of the insole 16 provided between the heel region 40 and the toe region 44 and provides support for the wearer's arch. It should be understood that there can be some degree of overlap between the regions. The heel region 40 includes a heel cushioning area 46 and a heel perimeter 47, the arch region 42 includes, an arch cushioning area 48 and an arch perimeter 49, and the toe region 44 includes a toe cushioning area 50 and a toe perimeter 51. It should be understood that the cushioning areas 46, 48, and 50 refer to the portions of the insole 16 that cushions the corresponding part of a wearer's foot, and the perimeters 47, 49, and 51 refer to portions of the insole perimeter 39 of the insole 16.

As shown in FIG. 3, the retaining wall 36 extends around the heel perimeter 47 and into the arch perimeter 49. For the design shown in FIG. 3, the retaining wall 36 does not extend into the toe perimeter 51. The retaining wall 36 is constructed so that it extends above the heel cushioning area top surface 52 and the arch cushioning area top surface 54 to an extent sufficient, to help retain the wearer's foot in its proper location on the insole 16. The retaining wall 36 can have a varying height depending upon whether it is located in the heel region 40 or the arch region 42. The retaining wall 36 can have a height that is sufficient for providing containment and/or support of the wearer's foot, but should not be so high that it causes discomfort. An exemplary range for the retaining wall 36 can be between about ¼ inch and about 1 inch. In many applications, it is expected that the retaining wall 36 will have a height of about ⅞ inch above the heel cushioning area top surface 52 and the arch cushioning area top surface 54. Because it is expected that the toe region 44 will be compressed more than the heel region 40 and the arch region 42, it is expected that the toe cushioning area top surface 56 will be lower than the heel cushioning area top surface 52 and the arch cushioning area top surface 54. In addition, it should be understood that the retaining wall 36 can decrease until it merges with the arch cushioning area top surface 54 and/or the toe cushioning area top surface 56.

The combination of the heel cushioning area 46 and the retaining wall 36 provided in the heel perimeter 47 provides a structure that can be referred to as the heel cup region 23 because it acts to contain the wearer's heel and keep it in a stationary position. The heel cushioning area 46 includes the contour design 22. In addition to providing visual interest to a customer, it is believed that the contour design 22 provides additional cushioning. The contour design 22 includes areas of relatively lower density foam 57 and areas of relatively higher density foam 58. The contour design 22 shown in FIG. 3 can be referred to as a starburst pattern 41 because it includes a relatively low density central area 59 surrounded by isolated domains of relatively low density foam 55. It should be understood that the reference to low density foam refers to the comparison with the adjacent areas of relatively higher density foam 58. The difference in height between the lower density foam areas 57 and the higher density foam areas 58 should be sufficient to be readily visible upon inspection of the insole 16, but should not be so large as to cause discomfort. In general, it is expected that the difference in height between the low density area 57 and the higher density areas 58 will be between about 1/16 inch and about 3/16 inch. It should be understood that the contour design may or may not be present in the heel cup region 23, and may include various designs such as those of interest to customers.

Figure 5:
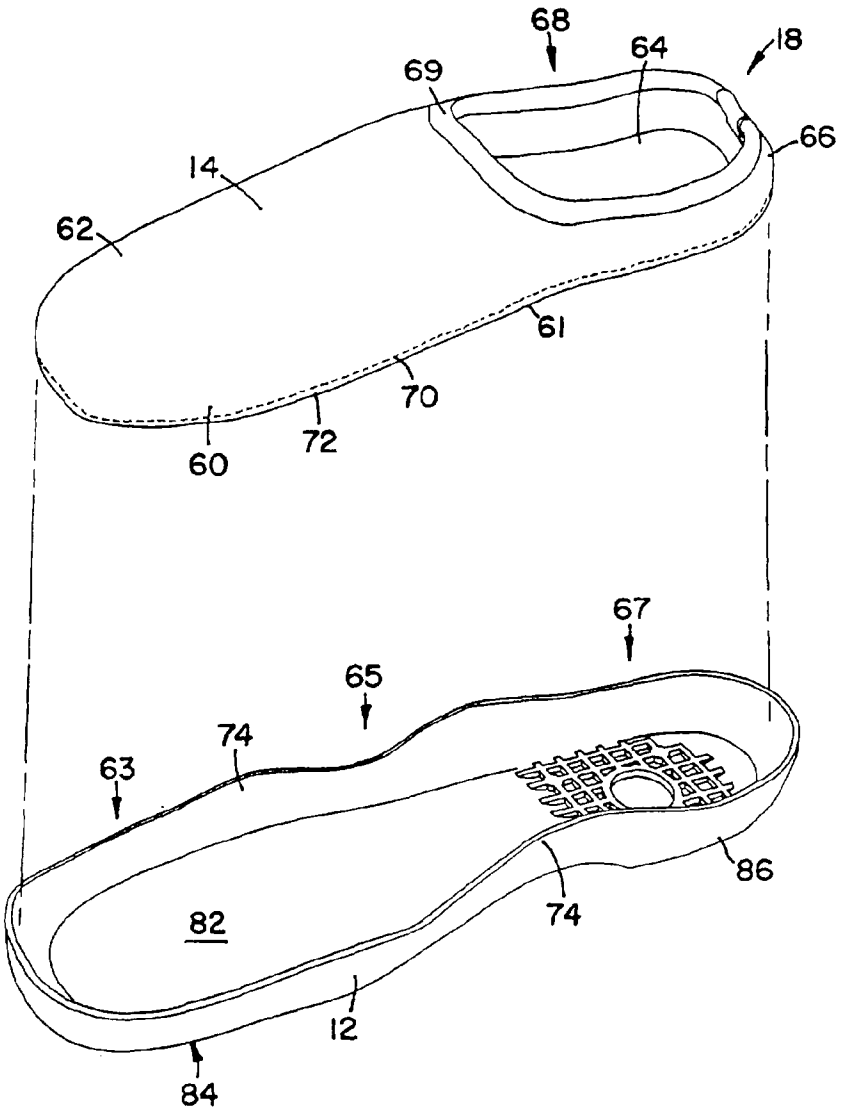
FIG. 5 is a perspective, assembly view of the slipper construction of FIG. 1.

Now referring to FIG. 5, the upper 14 is shown separated from the outsole 12. The upper 14 includes an outsole attachment area 60, a foot covering area 62, and a stabilizing member 64. The outsole attachment area 60 is provided along the upper 14 covering the length of attachment between the upper 14 and the outsole 12. For the construction of the upper 14 shown in FIG. 5, the outsole attachment area 60 extends around the entire upper circumference 61. That is, the outsole attachment area 60 extends to provide attachment to the outsole 12 in the toe region 63, the arch region 65, and the heel region 67. The combination of the outsole attachment area 60 and the foot covering area 62 provided in the heel region 40 can be referred to as the heel wrap upper 66. The foot covering area 62 includes an opening 68 that allows for the insertion of a foot into the foot receiving area 18. Binding 69 can be provided along the foot covering area 62 to provide a finished appearance to the opening 68.

The stabilizing member 64 is attached to the upper 14 along the outsole attachment area 60. One technique for attaching the stabilizing member 64 along the outsole attachment area 60 is by sewing to create a stitch line 70 and a seam allowance 72. The upper 14 can then be attached to the outsole 12 along the outsole retaining wall 74 to hide the stitch line 70 and the seam allowance 72. The upper 14 can be attached to the outsole 12 by stitching to create a stitch line 80 as shown in FIG. 1.

The outsole 12 includes an outsole top side 82, an outsole bottom side 84, and an outsole retaining wall 74. The outsole retaining wall 74 extends above the outsole top side 82 along the perimeter 86. It should be understood that the outsole can be provided having various configurations and can be prepared by various manufacturing techniques without any preference for particular materials and processes except to recognize that certain preferences may be based on various reasons including cost and customer preference.

The upper 14 can be prepared from any fabric material commonly used in the manufacture of a slipper. The stabilizing member 64 can be provided from the same type of material used to provide the outsole attachment area 60. In general, the stabilizing member 64 is provided to assist with the attachment of the upper 14 to the outsole 12. The stabilizing member 64 helps the upper 14 maintain its shape during the step of attaching the upper 14 to the outsole 12. Although the upper can be attached to the outsole by stitching, it should be appreciated that other techniques can be used including adhesive bonding. Although the upper 14 is shown attached to the outsole 12 along the entire perimeter 86 in the embodiment shown in FIG. 1, alternatives can exist where the upper is not attached to the outsole in at least a portion of the perimeter.

Figure 6:
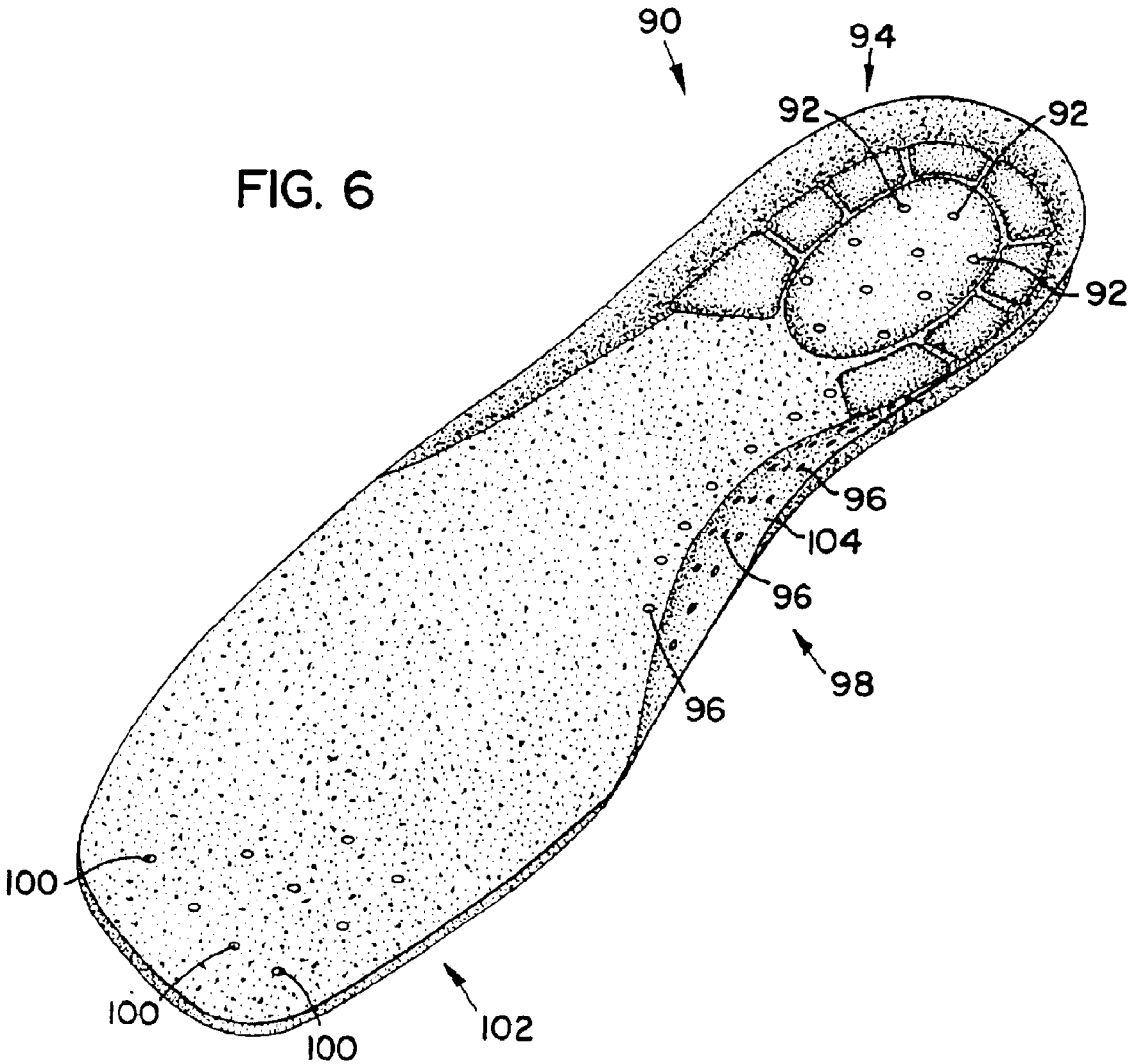
FIG. 6 is a perspective view of an alternative embodiment of an insole according to the principles of the invention.

Now referring to FIG. 6, an alternative design of an insole according to the principles of the invention is shown at reference numeral 90. The insole, 90 includes a plurality of perforations or holes 92 provided in the heel region 94, a plurality of perforations 96 provided in the arch region 98, and a plurality of perforations 100 provided in the toe region 102. The perforations provide for additional air circulation in order to make the slipper more comfortable to a wearer. In addition, the presence of the perforations 96 in the arch support 104 helps provide flexibility to the arch support 104. In general, slippers are available in whole sizes, and slippers are generally not available in half sizes. Accordingly, by providing a more flexible arch support 104, it is possible to provide the insole 90 with a larger degree of fit for various individuals.

The insole according to the invention can be characterized as a removable, contoured footbed. That is, the insole is removable from the insole receiving area. It is expected that the insole may be glued in place within the insole receiving area to simply hold it in place until it is desired to remove the insole. The insole can be glued in place within the insole receiving area by spot gluing or placing spots of glue between the insole and the stabilizing member. In addition, if the upper is attached to the outsole without a stabilizing member, the insole can be glued directly to the outsole. The insole can be referred to as a footbed because of the presence of the retaining wall and the arch support. The insole can be referred to as a contoured footbed because of the additional presence of the contour design. It is expected that the combination of the retaining wall and the arch support, when combined with the outsole retaining wall, will help stabilize a wearer's foot within the slipper.

Various embodiments of the slipper and contoured footbed according to the invention are shown in U.S. application Ser. No. 29/165,186 entitled "Closed Back Slipper With Contoured Footbed" and filed on Aug. 5, 2002, now U.S. Pat. No. D485,664; U.S. application Ser. No. 29/165,190 entitled "Open Toe Slipper With Contoured Footbed" and filed on Aug. 5, 2002, now U.S. Pat. No. D485,665; U.S. application Ser. No. 29/165,204 entitled "Closed Toe Slipper With Contoured Footbed" and filed on Aug. 5, 2002, now U.S. Pat. No. 485,666; and U.S. application Ser. No. 29/165,183 entitled "Contoured Footbed" and filed on Aug. 5, 2002, now U.S. Pat. No. D490,970, The entire disclosures of these four U.S. patent applications are incorporated herein by reference.

Now referring to FIGS. 7–10, alternative insoles according to the present invention are shown. It is pointed out that the insoles of FIGS. 7–10 are provided in U.S. application Ser. No. 29/165,183 that is incorporated herein by reference. Additional views of the insoles of FIGS. 7–10 can be found in U.S. application Ser. No. 29/165,183.

Figure 7:
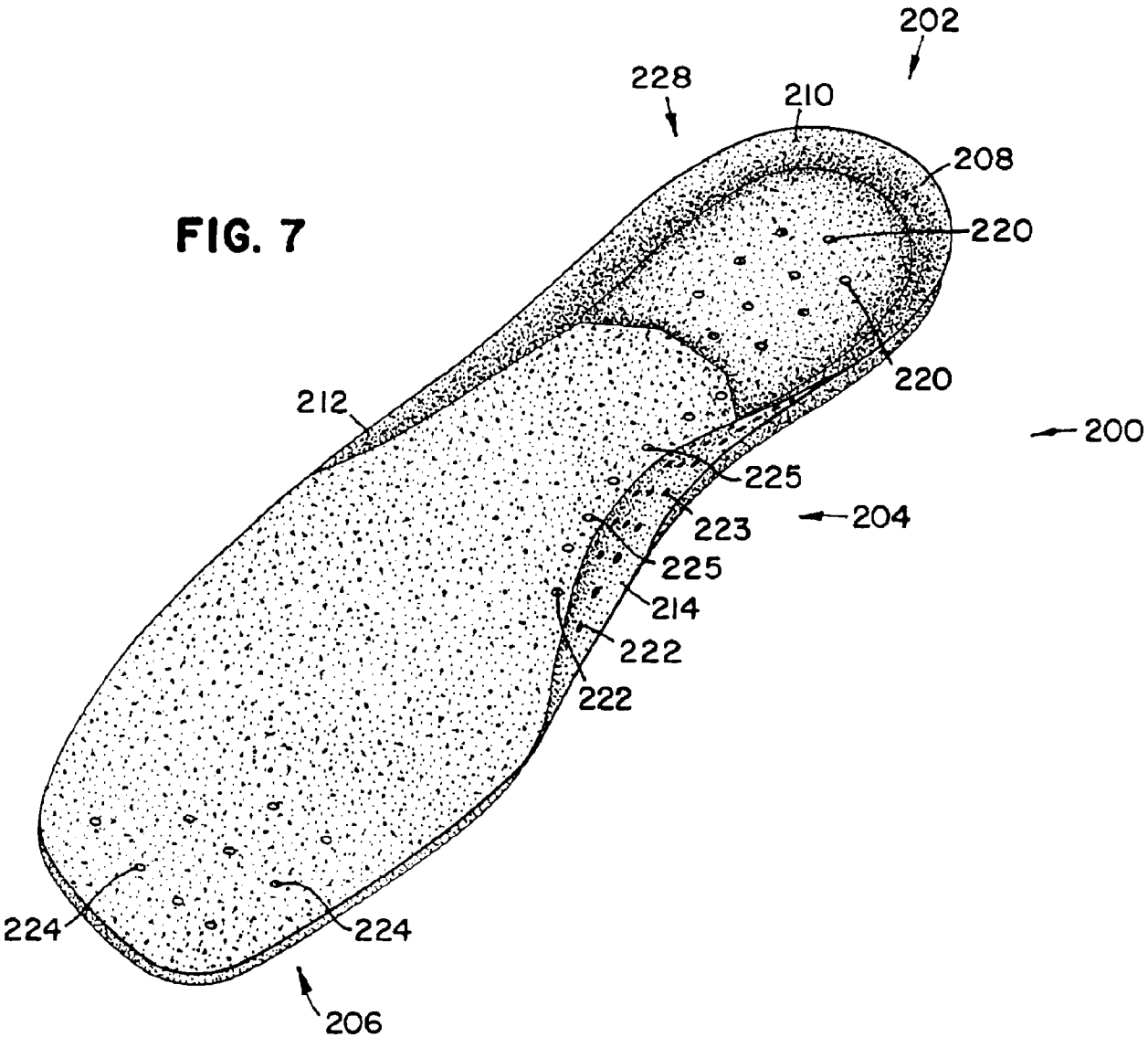
FIGS. 7–10 are perspective views of alternative embodiments of insoles according to the principles of the invention.
Figure 8:
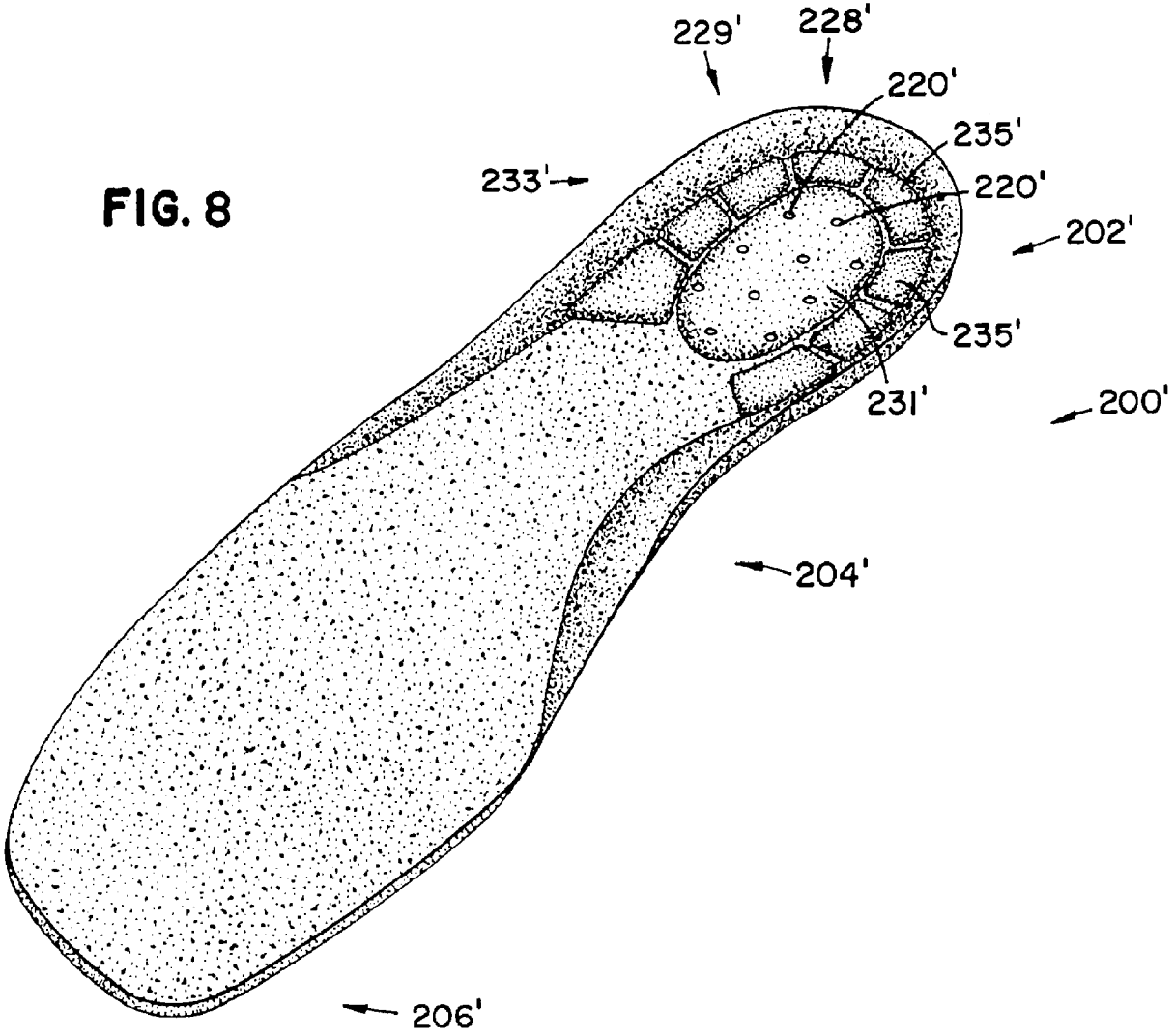
Figure 9:
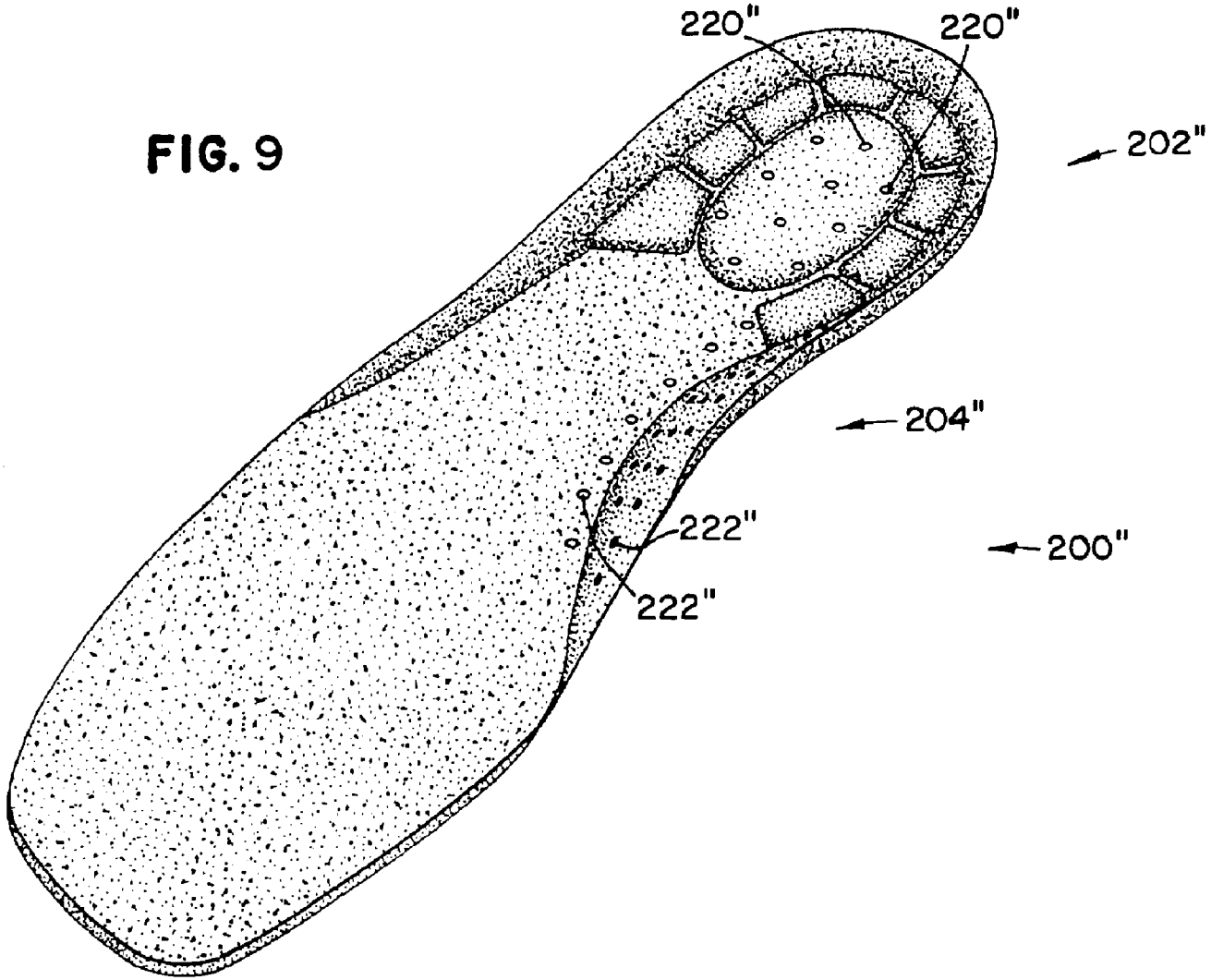
Figure 10:
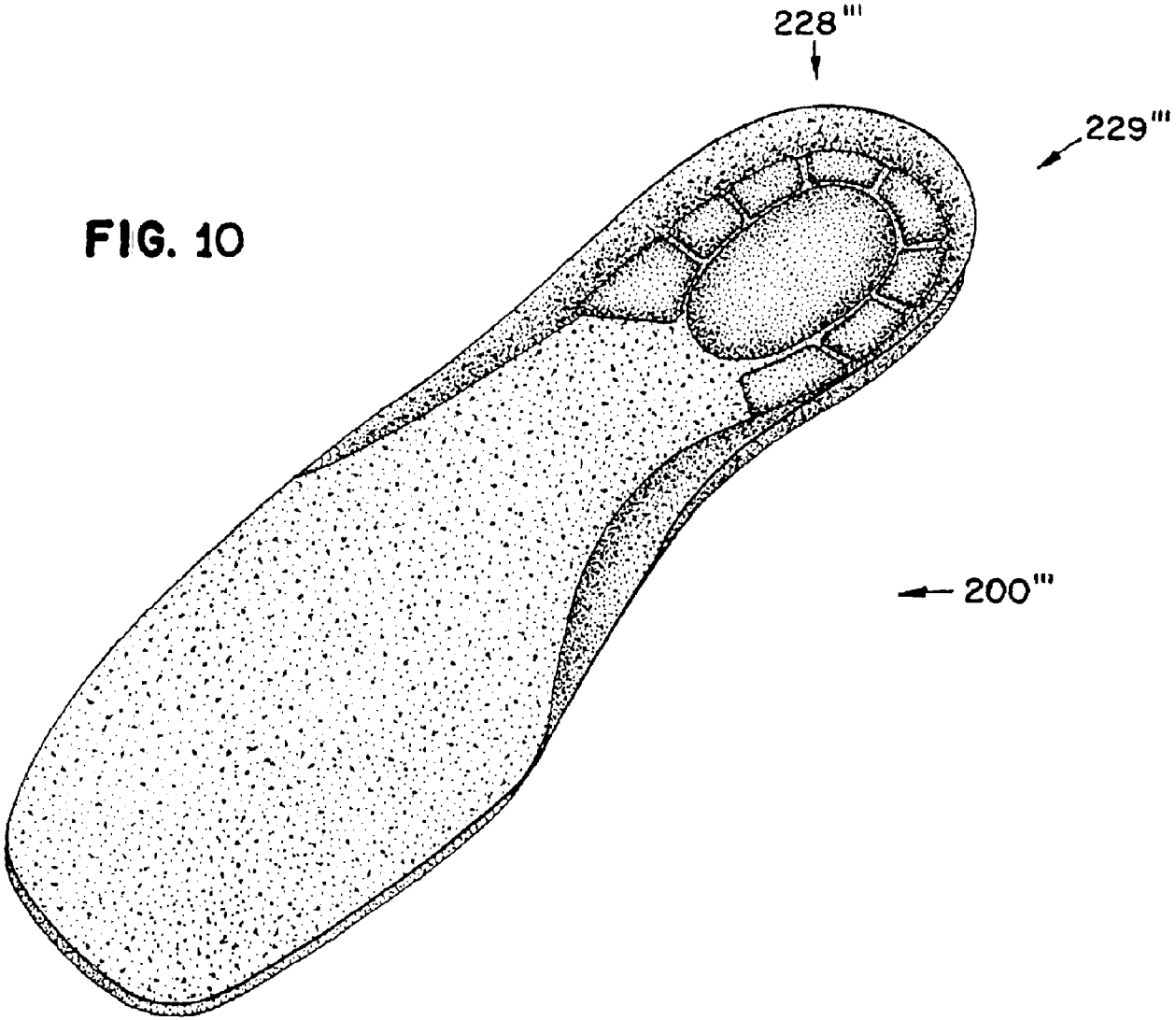

Now referring to FIG. 7, the insole 200 includes a heel region 202, an arch region 204, and a toe region 206. A retaining wall 208 extends around the heel perimeter 210 and at least part way into the arch perimeter 212. It is pointed out that the arch support 214 forms a part of the retaining wall 208 that extends onto the arch perimeter 212. These features of the insole 200 (FIG. 7) are similarly found in the insole 200' (FIG. 8), the insole 200" (FIG. 9), and the insole 200'" (FIG. 10).

The insole 200 is shown having a plurality of perforations 220 in the heel region 202, a plurality of perforations 222 in the arch region 204, and a plurality of perforations 224 in the toe region 206. The plurality of perforations 222 include a plurality of perforations 223 in the arch support 214 and a plurality of perforations 225 in the arch region 204 that are not in the arch support 214. In general, the perforations provide air flow and in the case of perforations 223, provide flexibility in the arch support 214. The heel cup region 228 of the insole 200 is shown without a contour design.

The insole 200' includes a plurality of perforations 220' in the heel region 202', and does not include perforations in the arch region 204' and the toe region 206'. In addition, the heel region 202' includes a contour design 229' provided as a starburst pattern in the heel cup region 228'. The perforations 220' are shown within the central area of low density foam 231' of the starburst pattern 233' and not in the outlying areas of low density foam 235' of the starburst pattern 233'. It should be understood that, if desired, the perforations can be provided in either or both of the central area of low density foam 231' or the outlying areas of low density foam 235'. The insole 200" includes perforations 220" in the heel region 202", and perforations 222" in the arch region 204". The insole 200'" includes no perforations and includes a contour design 229'" in the heel cup region 228'".

It should be understood that the various insole configurations according to the invention can be placed in the insole receiving area of various slipper configurations. FIGS. 11–16 are provided showing alternative slipper configurations that include representative examples of insole configurations. The slipper configurations shown in FIGS. 11–16 can be found in U.S. application Ser. Nos. 29/165,186, 29/165,190, and 29/165,204 that are incorporated herein by reference. It should be understood that the various insole configurations according to the invention, such as those shown in FIGS. 3 and 6, can be substituted for those insoles shown in FIGS. 11–16.

Figure 11:
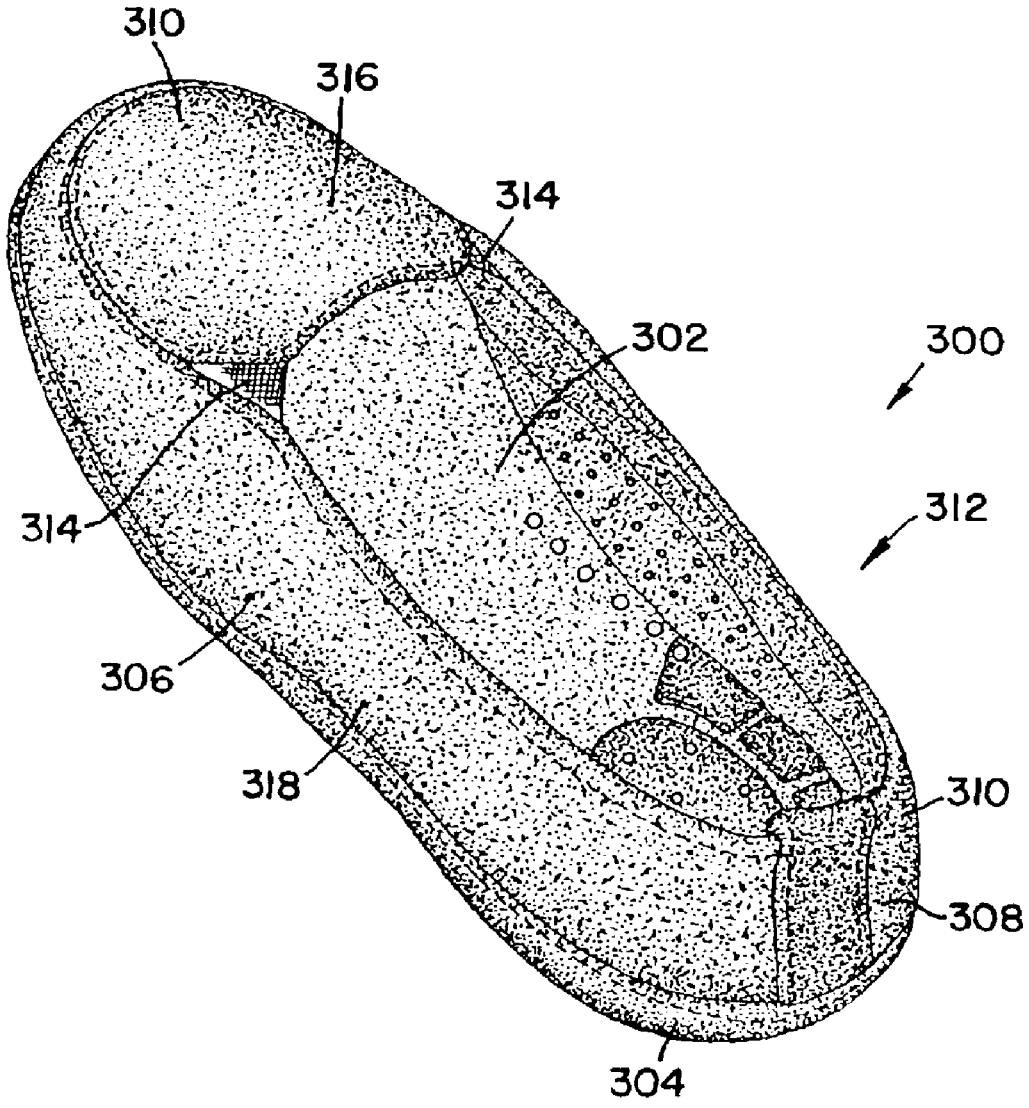
FIG. 11 is a perspective view of a closed back slipper according to the principles of the invention.
Figure 12:
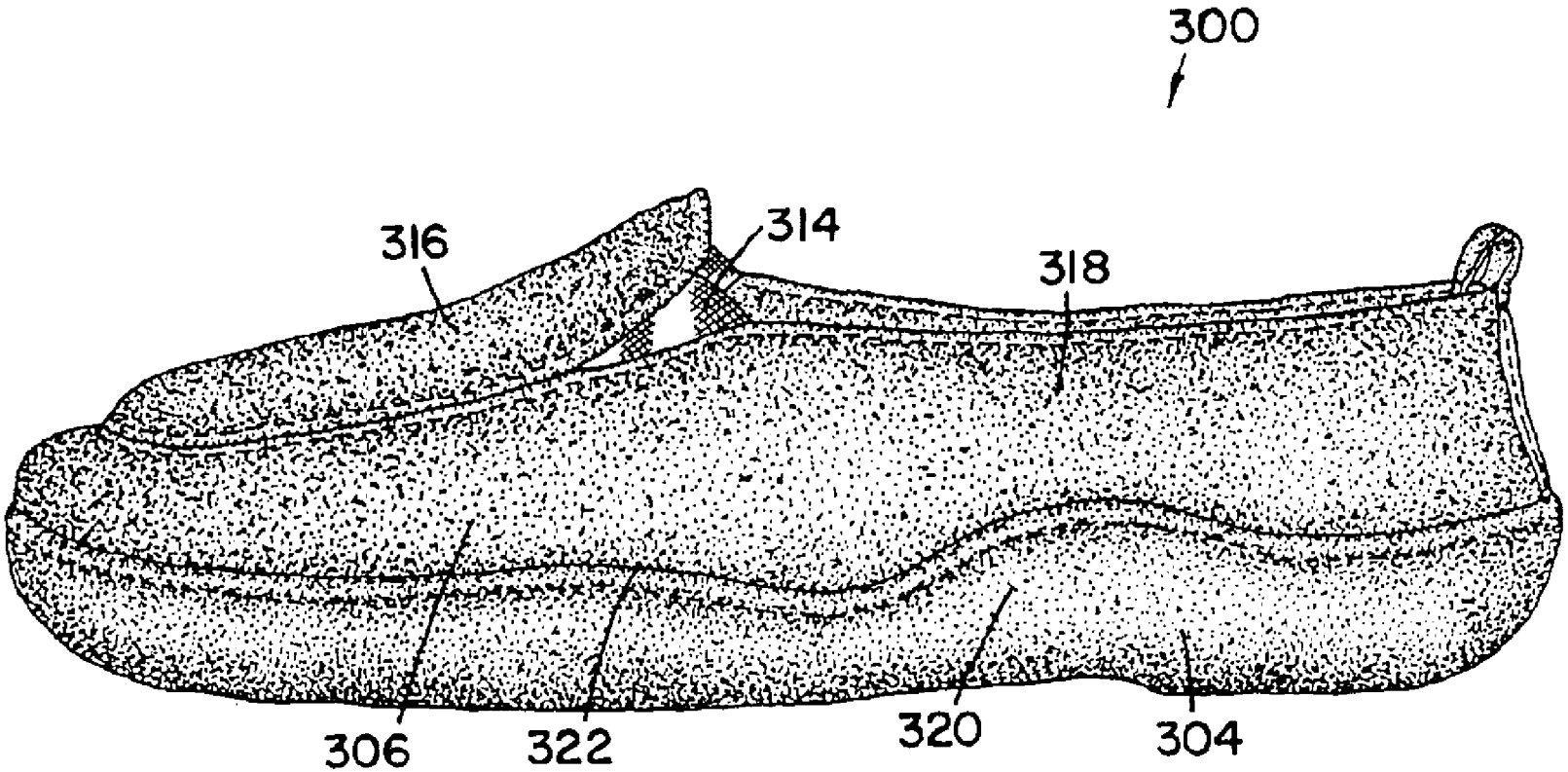
FIG. 12 is a side view of the closed back slipper of FIG. 11.

Now referring to FIG. 11, an alternative slipper design according to the invention is shown at reference number 300. The slipper 300 includes an insole 302, an outsole 304, and an upper 306. The insole 302 can be provided as an insole or footbed according to the principles of the invention. The slipper 300 can be referred to as a closed back slipper because the upper 306 is constructed to include a heel wrap upper 308 that extends upward from the outsole 304 so that it wraps and encloses the wearer's heel. The upper 306 additionally includes a foot covering area 310 that covers the top of the wearer's foot. The upper 306 includes an opening through which the wearer's foot passes when taking on or off the slipper 300. The upper 306 can include elastic members 314 to help allow the wearer's foot to fit through the opening 312 by allowing a stretch between the foot top covering upper 316 and the side upper 318. The outsole 304 includes an outsole retaining wall 320 and the upper 306 is shown attached to the outsole retaining wall 320 along the outsole perimeter 322. As shown in FIG. 12, the outsole 304 can have an outsole retaining wall 320 having various configuration and styling as long as the upper is capable of attaching thereto.

Figure 13:
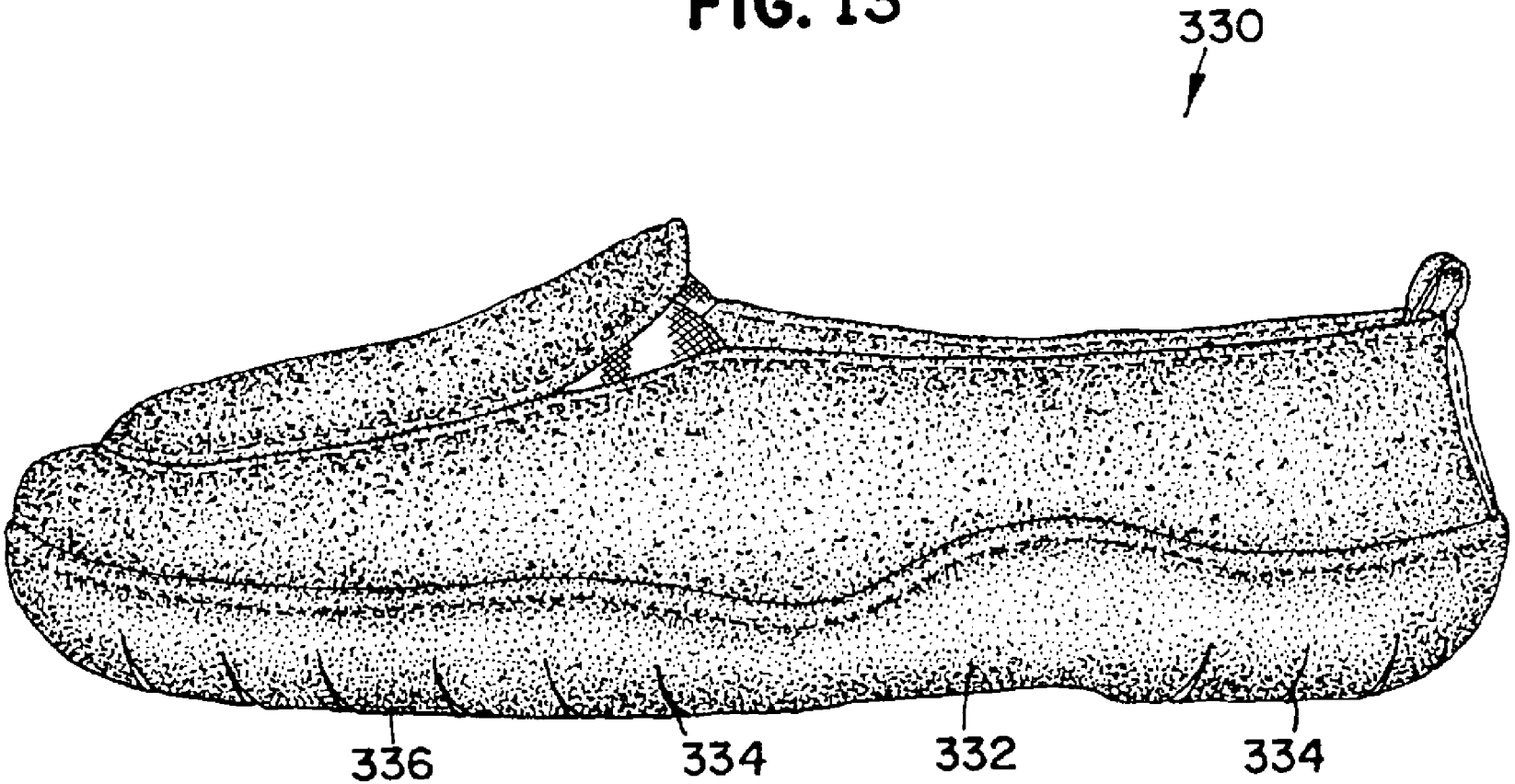
FIG. 13 is a side view of an alternative closed back slipper according to the principles of the invention.

Now referring to FIG. 13, a slipper design according to the invention is shown at reference number 330. The slipper design 330 is similar to the slipper design 300 except that the outsole 332 includes cuts 334 that are visible when viewing the outsole exterior surface 336. The cuts can be provided in any desired design and can be provided to help increase flexibility and/or traction.

Figure 14:
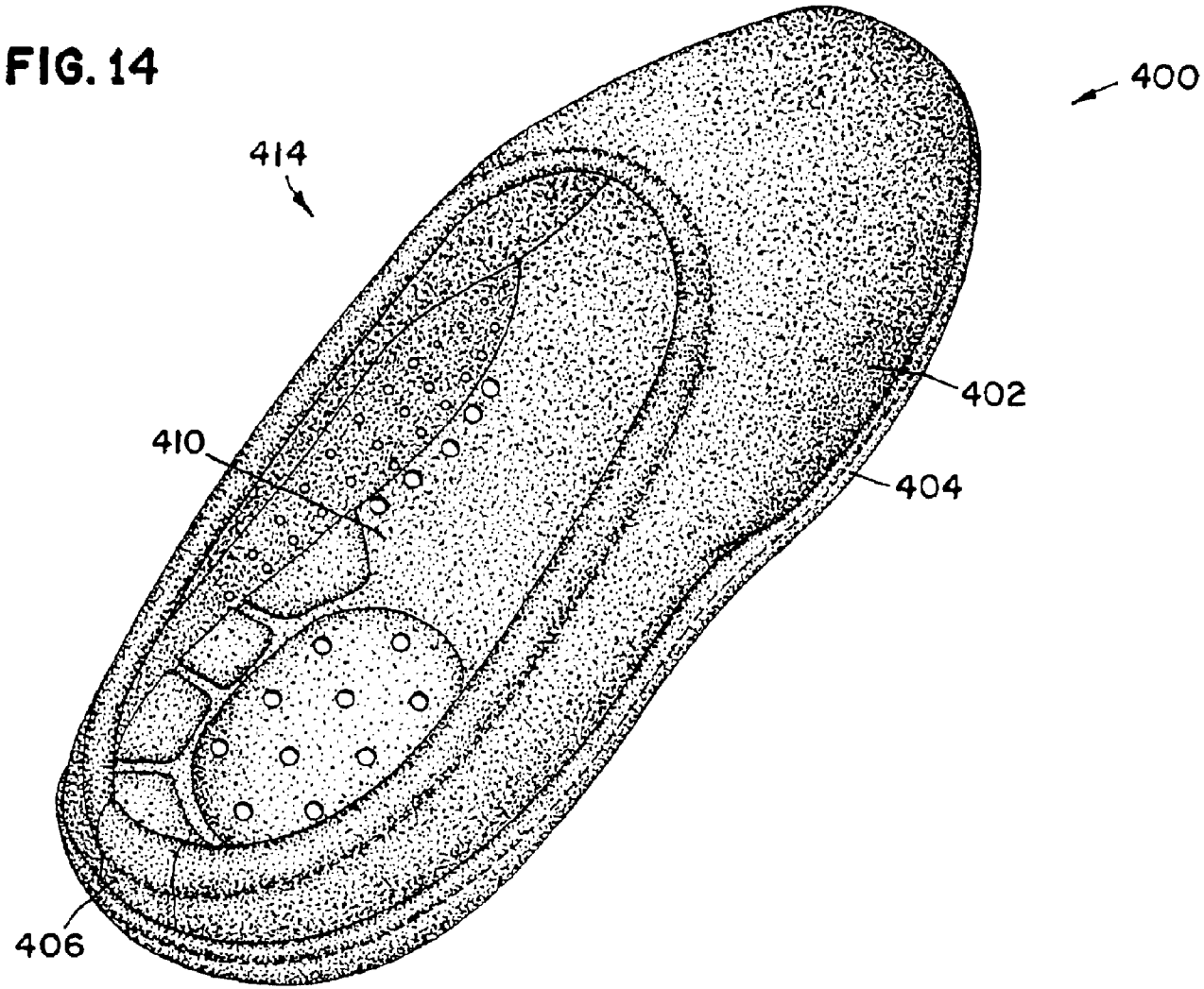
FIG. 14 is a perspective view of an open back slipper according to the principles of the invention.
Figure 15:
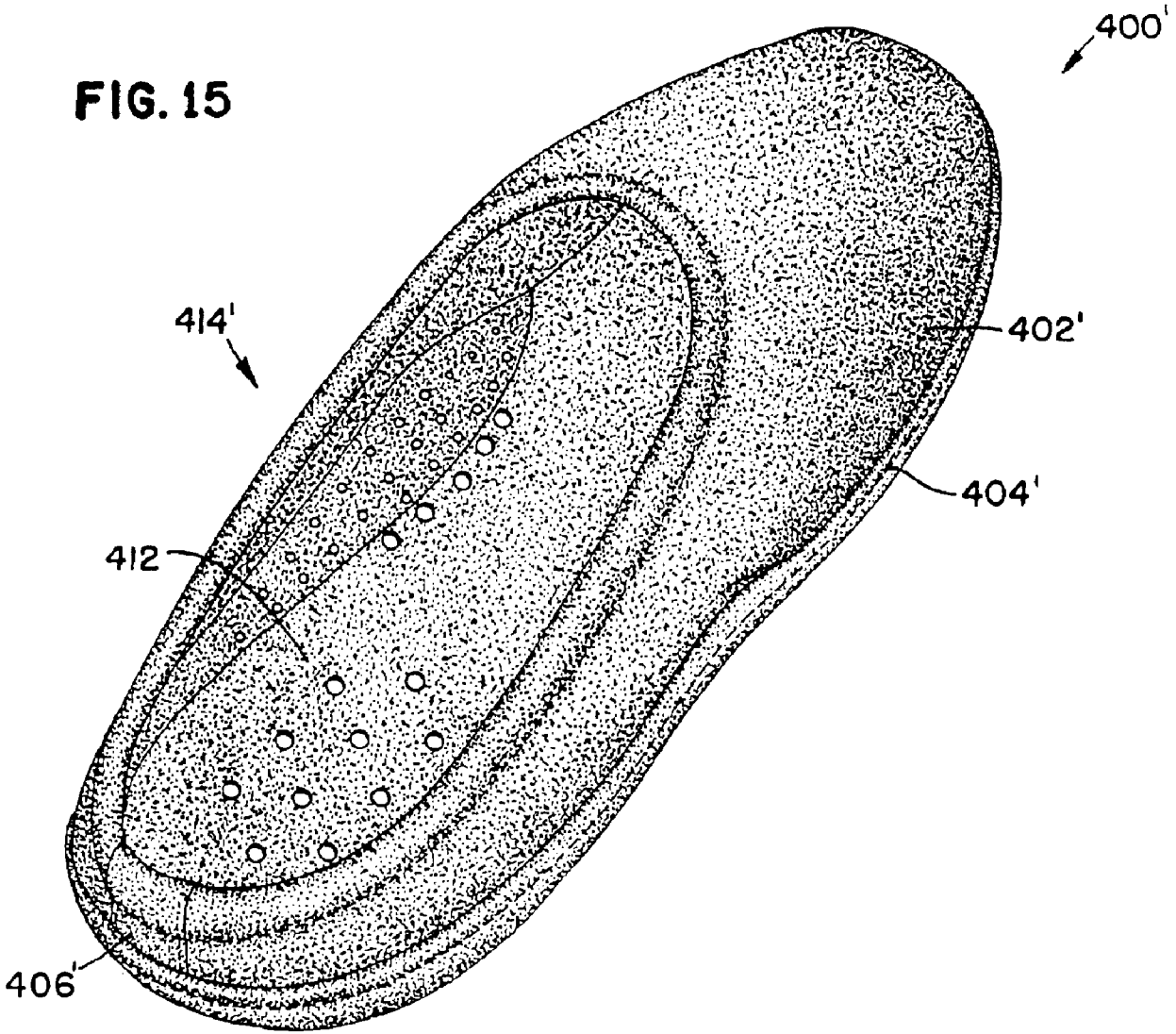
FIG. 15 is a perspective view of an open back slipper according to the principles of the invention.

Now referring to FIGS. 14 and 15, alternative slipper designs according to the invention are shown at reference numbers 400 and 400'. The slippers 400 and 400' include an upper 402 and 402', and an outsole 404 and 404'. The upper 402 and 402' include a heel wrap portion 406 and 406' that is relatively low to the outsole. Because the heel wrap portion 406 and 406' is so low, the slippers 400 and 400' can be referred to as open back slippers. By providing open back slippers, it is generally easier to insert or remove a wearer's foot.

The slippers 400 and 400' differ by the insoles 410 and 412 provided in the insole receiving areas 414 and 414'.

Figure 16:
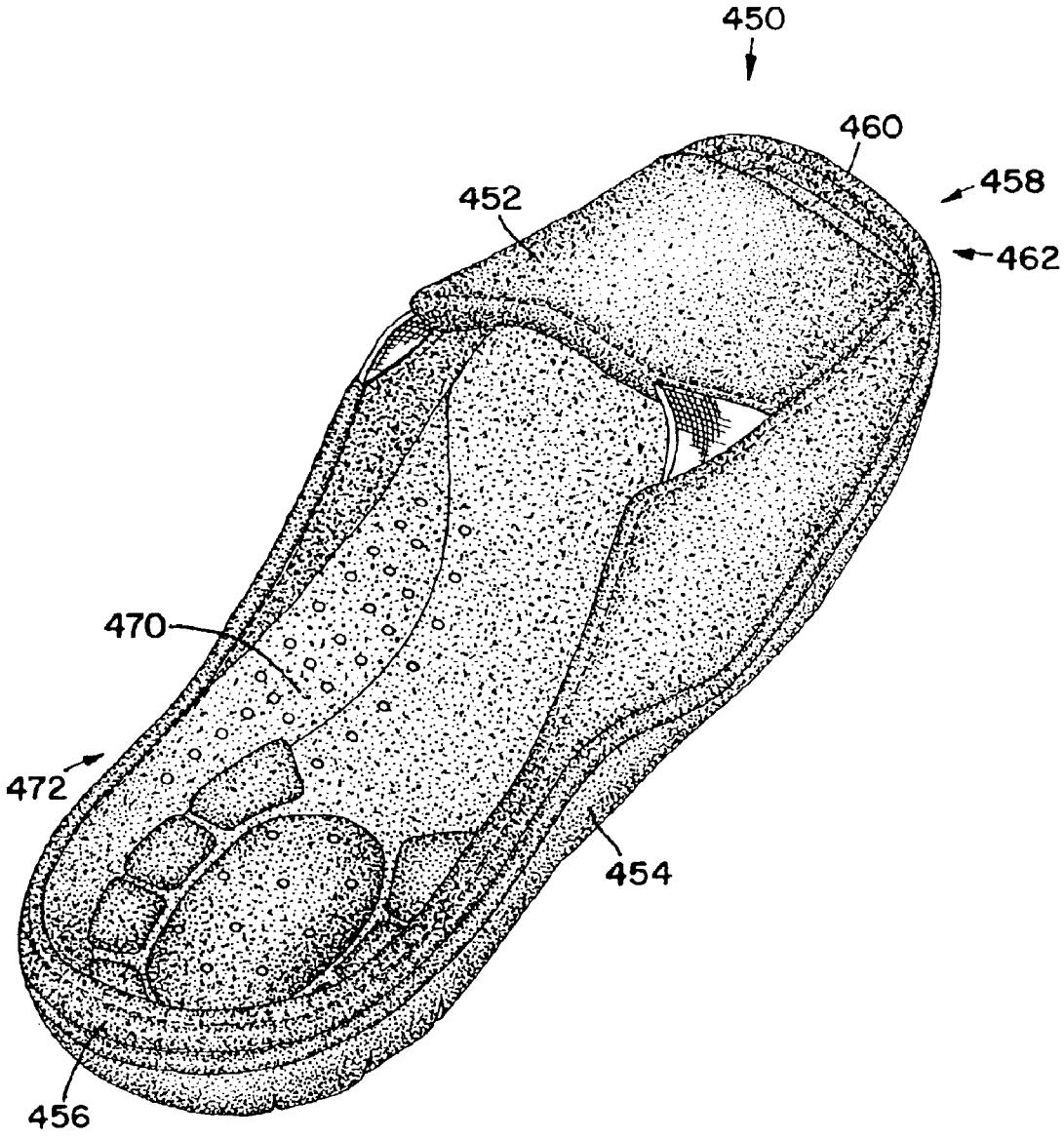
FIG. 16 is a perspective view of an open toe slipper according to the principles of the invention.

Now referring to FIG. 16, an alternative slipper design is shown at reference number 450. The slipper design 450 includes an upper 452 and an outsole 454. The upper 452 includes a heel wrap portion 456 that can be considered sufficiently low so that the slipper 450 can be referred to as an open back slipper. In addition, the upper 452 includes an opening 458 above the location of the wearer's toes. Accordingly, the slipper 450 can be referred to as an open toe slipper. In the case of the slipper 450, the upper 452 includes a toe wrap upper 460 that attaches to the outsole 454 in the toe area 462. The slipper 450 includes an insole 470 that is provided within the insole receiving area 472.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method for manufacturing a slipper that includes an upper attached to an outsole, the method comprising:

(a) providing the upper comprising an outsole attachment area, a foot covering area, and a stabilizing member, (b) attaching the stabilizing member along the outsole attachment area to provide an insole receiving area between the stabilizing member and the foot covering area;

(c) attaching the outsole attachment area of the upper to the outsole;

(d) compression molding a foam structure to form an insole comprising a foam layer having a first foam side and a second foam side, to provide an insole comprising:

(i) a heel region having a heel cushioning portion and a heel perimeter portion, wherein the heel perimeter portion comprises a retaining wall that extends above the top surface of the heel cushioning portion;

(ii) an arch region having an arch cushioning portion and an arch perimeter portion, wherein the arch perimeter portion comprises an arch support that extends above the top surface of the arch cushioning portion; and (iii) a toe region having a toe cushioning portion and a toe perimeter portion; and (iv) wherein the heel cushioning portion includes a first higher density foam area, a first central lower density foam area substantially surrounded by the first higher density foam area, and a second tower density foam area positioned along a heel perimeter portion; and (e) placing the insole within the insole receiving area.

2. A method according to claim 1, wherein the step of attaching the upper and the outsole comprises stitching the outsole attachment area to an outsole retaining wall along a circumference of the outsole.

3. A method according to claim 1, further comprising forming a laminate of the foam layer and a fabric layer having a first fabric side and a second fabric side, wherein the second fabric side is attached to the first foam side.

4. A method according to claim 1, wherein the step of placing an insole within the insole receiving area comprises adhering the insole to the stabilizing member.

5. A method according to claim 1, wherein the step of compression molding a structure to form an insole comprises forming the first higher density foam area to have height that is less than a height of the first lower density foam area.

6. A method according to claim 5, wherein:

(a) the stem of compression molding a structure to form an insole comprises forming a difference between the height of the first lower density foam area and the first higher density foam area of at least 1/16 inch so that the first lower density foam area projects above the surface of the first higher density foam area on the first foam side; and (b) the insole is placed within the insole receiving area with the first foam area facing the foot covering area.

7. A method according to claim 5, wherein the step of compression molding a structure to form an insole comprises forming a difference between the height of the first lower density foam area and the first higher density foam area of at most 3/16 inch.

8. A method according to claim 5, wherein the compression molding step is carried out on a unitary place of foam to create the insole, so that the first high and low density foam areas are part of the unitary piece of foam.

9. A method according to claim 8, wherein the step of compression molding is carried out so that the first lower density foam area is surrounded by a plurality of isolated lower density foam areas wherein the plurality of isolated lower density foam areas are separated from each other by portions of the first higher density foam area.

10. A method according to claim 8, wherein the step of compression molding is carried out so that the first lower density foam area is oval shaped.

11. A method according to claim 1, wherein the step of compression molding is carried out so that the toe perimeter portion does not include a retaining wall.

12. A method according to claim 1, wherein the step of compression molding is carried out so that the heel cushioning portion comprises a starburst pattern.

13. A method according to claim 1, further comprising providing ethylene vinyl acetate for the formation of the foam layer.

14. A method according to claim 1, further comprising forming a laminate of the foam layer and a fabric layer having a first fabric side and a second fabric side, wherein the second fabric side is attached to the first foam side.

15. A method according to claim 14, further comprising providing the fabric layer wherein the fabric layer has a nap of less than 4 mm.

16. A method according to claim 1, wherein the step of compression molding is carried out so that the arch perimeter portion comprises a retaining wall that extends above the top surface of the heel cushioning portion.

17. A method according to claim 16, wherein the step of compression molding is carried out so that the retaining wall of the heel perimeter portion extends about ¼ inch to about 1 inch above the top surface of the heel cushioning portion.

18. A method according to claim 1, wherein the step of compression molding is carried out so that the arch support extends about ¼ inch to about 1 inch above the top surface of the arch cushioning portion.

19. A method according to claim 1, further comprising creating a plurality of perforation in the arch support for increasing the flexibility of the arch support.

20. A method according to claim 1, further comprising creating a plurality of perforations in at least one of the heel region, the arch region, and the toe region for increasing air circulation.

21. A method according to claim 20, wherein the perforations are created in the heel region, arch region and toe region.

22. A method according to claim 21, wherein the perforation are positioned so that the insole comprises a perforation-free area, that is adjacent to the heel region, arch region and toe region.

23. A method according to claim 20, wherein the perforation are positioned so that the arch region comprises a plurality of perforations and the perforations in the arch region are concentrated on and near the arch support.

24. A method according to claim 20, wherein the perforation are positioned so that the toe region comprises perforations and the perforations in the roe region are concentrated near an end of the insole.

25. A method according to claim 20, wherein the perforations are positioned so that the heel region comprises perforations an the perforations in the heel region are concentrated in the first lower density foam area.

26. A method for manufacturing a slipper that includes an upper attached to an outsole, the method comprising:

(a) providing the upper comprising an outsole attachment area and a foot covering area, (b) attaching the outsole attachment area of the upper to the outsole to provide an insole receiving area between the outsole and the foot covering area;

(c) compression molding a foam structure to form an insole comprising a foam layer having a first foam side and a second foam side, to provide an insole comprising:

(i) a heel region having a heel cushioning portion and a heel perimeter portion, wherein the heel perimeter portion comprises a retaining wall that extends above the top surface of the heel cushioning portion;

(ii) an arch region having an arch cushioning portion and an arch perimeter portion, wherein the arch perimeter portion comprises an arch support that extends above the top surface of the arch cushioning portion; and (iii) a toe region having a toe cushioning portion and a toe perimeter portions; and (iv) wherein the heel cushioning portion includes a first higher density foam area and a first lower density foam area that is surrounded by the first higher density foam area, wherein the first lower density foam area is surrounded by a plurality of isolated lower density foam areas, and the plurality of isolated lower density foam areas are separated from each other by portion of the first higher density foam area; and (d) placing the insole within the insole receiving area.

27. A method according to claim 26, wherein the step of compression molding is carried out so that the toe perimeter portion does not include a retaining wall, the retaining wall of the heel perimeter portion extends about ¼ inch to about 1 inch above the top surface of the heel cushioning portion, and the arch support extends about ¼ inch to about 1 inch above the top surface of the arch cushioning portion.

28. A method according to claim 26, further comprising creating a plurality of perforations in the heel region, the arch region, and the toe region for increasing air circulation, wherein the perforations are positioned so that the insole comprises a perforation-free area that is adjacent to the heel region, arch region and toe region, wherein the perforations in the arch region are concentrated on and near the arch support, wherein the perforations in the arch region are concentrated on and near the arch support, and wherein the perforations in the toe region are concentrated near an end of the insole.

29. A method according to claim 26, further comprising creating a plurality of perforations in the heel region, the arch region, and the toe region for increasing air circulation, wherein the perforations are positioned so that the insole comprises a perforation-free area that is adjacent to the heel region, arch region and toe region.

30. A method according to claim 26, wherein the compression molding step is carried out on a unitary piece of foam to create the insole, so that the first high and low density foam areas are part of the unitary piece of foam.

* * * * *